US007253786B1

(12) United States Patent
Logozzo

(10) Patent No.: US 7,253,786 B1
(45) Date of Patent: Aug. 7, 2007

(54) REINFORCED MONOPOLE CONSTRUCTION

(76) Inventor: Rocco Logozzo, 930 Old Medford Ave., Medford, NY (US) 11783

( * ) Notice: Subject to any disclaimer, the term of this patent is extended or adjusted under 35 U.S.C. 154(b) by 0 days.

(21) Appl. No.: 10/861,113

(22) Filed: Jun. 4, 2004

Related U.S. Application Data

(60) Provisional application No. 60/475,672, filed on Jun. 4, 2003.

(51) Int. Cl.
*H01Q 1/12* (2006.01)

(52) U.S. Cl. ..... 343/890; 52/721.4; 52/723.1; 52/723.2

(58) Field of Classification Search ..... 52/723.1, 52/721.4, 721.5, 723.2, 724.5, 730.1, 736.3, 52/763.4, 737.4, 737.5, 296; 343/890
See application file for complete search history.

(56) References Cited

U.S. PATENT DOCUMENTS 5,971,345 A * 10/1999 Khalaf ..... 248/512
6,131,349 A * 10/2000 Hill ..... 52/292
6,453,636 B1 * 9/2002 Ritz ..... 52/736.4
6,563,475 B2 * 5/2003 Ianello et al. ..... 343/890
6,710,751 B2 * 3/2004 Ianello et al. ..... 343/890
6,768,474 B2 * 7/2004 Hunt ..... 343/892
6,901,717 B2 * 6/2005 Brunozzi et al. ..... 52/723.1

* cited by examiner

*Primary Examiner*—Tho Phan
(74) *Attorney, Agent, or Firm*—James M. Deimen

(57) ABSTRACT

A new reinforced monopole cellular telephone tower comprises a plurality of flanged pipes strapped to the exterior of the monopole tower. The straps retain the pipes to the monopole tower in a spaced relationship, and the flanges permit the pipes to be bolted together. The flanged pipes form columns about the monopole tower. Elastomeric pads are placed between the flanges at some or all of the bolted flanged connections to reduce the bending moment at the connections. The thickness of the pads may vary depending on vertical location, and some connections at lower levels may not require the pads. The elastomeric pads allow the upper portion of the monopole tower to retain most of its flexibility without unduly overstressing the pipe reinforcing that is undergoing high compression during high wind conditions.

8 Claims, 5 Drawing Sheets

REINFORCED MONOPOLE CONSTRUCTION

This application claims the benefit of provisional patent application No. 60/475,672 filed Jun. 4, 2003.

BACKGROUND OF THE INVENTION

The field of the invention pertains to antenna towers and, in particular, to towers for cellular phone antennas, sometimes popularly known as cell towers. Cell towers commonly are constructed in one of two forms. Either the towers are constructed of open steel truss work or a single hollow tube of welded steel typically referred to as a monopole. In both varieties, the towers are fastened to a concrete base and gracefully taper upwardly more than 100 feet to sometimes 220 feet. Cellular telephone antennas are quite massive in appearance in comparison with radio and other common antennas; therefore, considerable windloading is applied to a cell tower by the one or two antennas normally installed.

The popularity of cellular telephones has resulted in a demand for additional capacity and, therefore, a demand for additional cellular telephone antennas and cell towers; however, cell towers are expensive to install and considered very unaesthetic by the general public. As a result, there is a demand for devices to reinforce existing cell towers to thereby permit installation of additional cellular telephone antennas. Examples of monopole cell towers and cellular telephone antennas are disclosed in U.S. Pat. No. 5,333,436 and U.S. Pat. No. 6,028,566. The former reveals a modular bolt-together form of cell tower with a massive antenna. The latter reveals the size and complexity of a cellular telephone antenna thereby emphasizing the bending moment that may be applied to the cell tower by the windage of the antenna. U.S. Pat. No. 6,173,537 illustrates a monopole with paraboloidal antennas commonly in use and likewise capable of producing considerable windage.

Numerous attempts have been made to reinforce monopole cell towers and previous antenna and utility towers prior to the development of cellular telephones. U.S. Pat. No. 6,453,636 discloses a plurality of half cylinders bolted about a monopole tower. Likewise, U.S. Pat. Appln. Pub. No. US2002/0056250 discloses a plurality of half cylinders bolted about a monopole tower. In contrast, U.S. Pat. Appln. Pub. No. US2002/0140621 discloses a concrete fill placed inside the monopole to provide more stiffening in compression to the monopole and the addition of external steel plates to the monopole.

U.S. Pat. Appln. Pub. No. US2002/0170261 discloses a plurality of square tubes attached by straps to the exterior of the monopole tower. The straps include square tubing collars through which the square tubing passes. U.S. Pat. Appln. Pub. No. US2002/0176951 discloses a load redistribution mechanism generally about the base of the monopole tower. U.S. Pat. Appln. Pub. No. US2003/0000165 discloses a precast post-tensioned segmental pole system wherein the post tensioning cables are located within the hollow interior of the tower. Fiber reinforced polymer composite panels bonded to the exterior surfaces of a steel monopole tower to strengthen the tower are disclosed in U.S. Pat. Appln. Pub. No. US2003/0010426. Various ways of covering the tower are shown.

U.S. Pat. Appln. Pub. No. US2003/0026923 discloses semi-circular sleeves to enclose and reinforce a monopole tower. In one embodiment, a compressible material is snugly fitted between the sleeve and the tower to transmit shear forces between the tower and the sleeve.

Historically, earlier utility towers of reinforced design are shown in U.S. Pat. No. 811,435 and U.S. Pat. No. 4,216,636 wherein a plurality of rods and connectors are used in open lattice patterns to construct the towers. An open lattice tower construction is shown in U.S. Pat. No. 854,366 wherein the open lattice surrounds and supports an insulated conduit therein. U.S. Pat. No. 1,786,631 discloses an early monopole utility tower with features to insulate the electric cables within the tower.

SUMMARY OF THE INVENTION

The new reinforced monopole construction comprises a plurality of flanged pipes strapped to the exterior of the monopole tower. The straps retain the pipes to the monopole tower in a spaced relationship, and the flanges permit the pipes to be bolted together. The flanged pipes form columns about the monopole tower.

Elastomeric pads are placed between the flanges at some or all of the bolted flanged connections to reduce the bending moment at the connections. The thickness of the pads may vary depending on vertical location, and some connections at lower levels may not require the pads. The elastomeric pads allow the upper portion of the monopole tower to retain most of its flexibility without unduly overstressing the pipe reinforcing that is undergoing high compression during high wind conditions.

As an option, the pipe reinforcing may be extended above the monopole tower to form a structure for attaching the additional antennas, or the monopole tower itself may be extended above its previous height.

Although directed to reinforcing cellular telephone towers, the new reinforced monopole construction is equally applicable to monopole electric utility towers and lighting towers.

DESCRIPTION OF THE PREFERRED EMBODIMENTS

Figure 1:
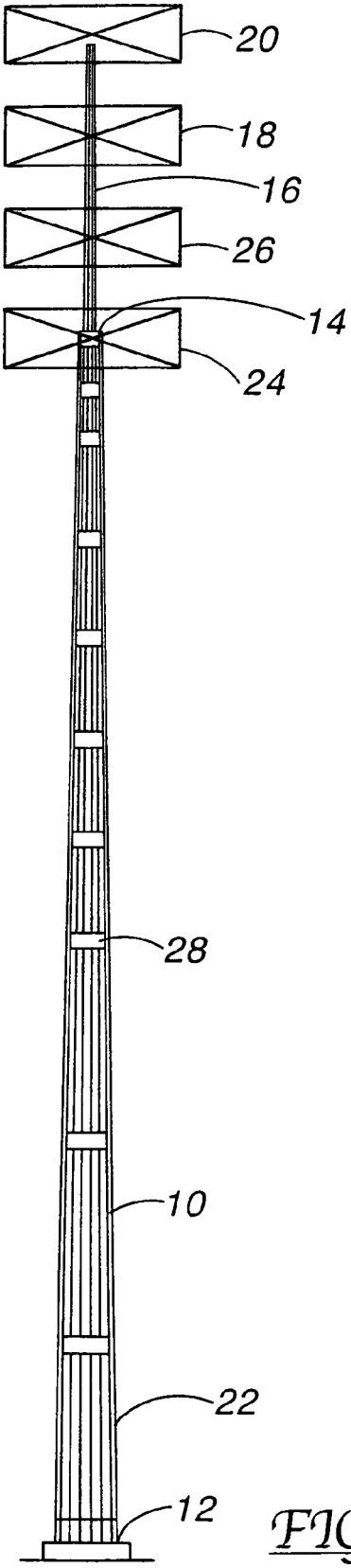
FIG. 1 illustrates a reinforced monopole tower in elevation view from base to antennas.

Illustrated in FIG. 1 is a monopole tower 10 typically having a polygonal shape in cross-section and tapering gracefully from the base 12 to the top at 14. Such towers are usually 100 feet to 220 feet in height and constructed of steel plates welded together. The towers are hollow, thereby allowing electric cables and microwave guides to be contained and protected inside. Above the tower top 14 is an antenna mast 16 and a pair of previously existing antenna arrays 18 and 20. Outside the tower 10 are pipe columns 22 extending from the tower base 12 to the tower top 14. As explained below, the pipe columns 22 are strapped 28 to the tower 10 and constructed of pipe lengths bolted together. The reinforcing pipe columns 22 permit the addition of antenna arrays 24 and 26 to the tower 10 and mast 16.

Figure 2:
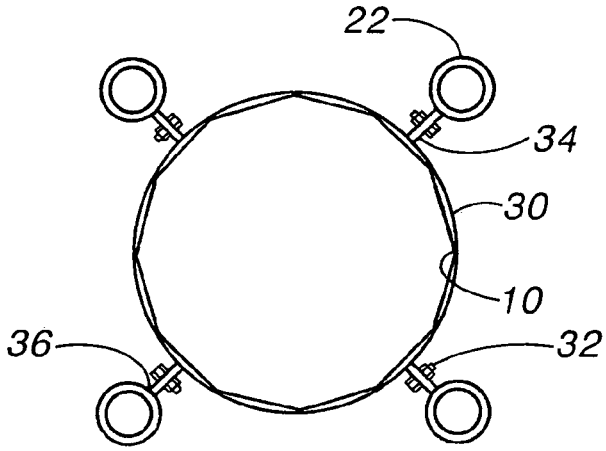
FIG. 2 is a first typical cross-section of the reinforced monopole construction.
Figure 3:
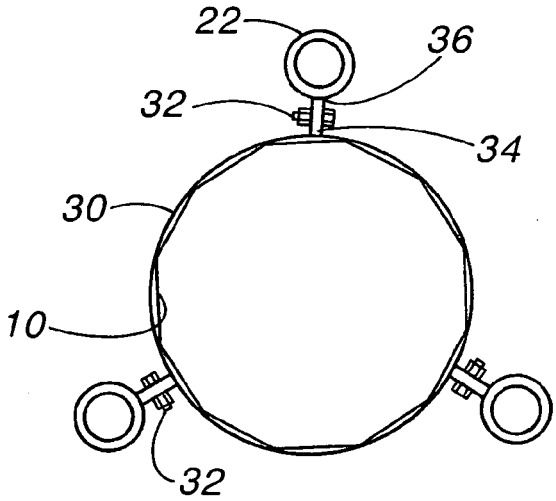
FIG. 3 is a second alternative typical cross-section of the reinforced monopole construction.
Figure 4:
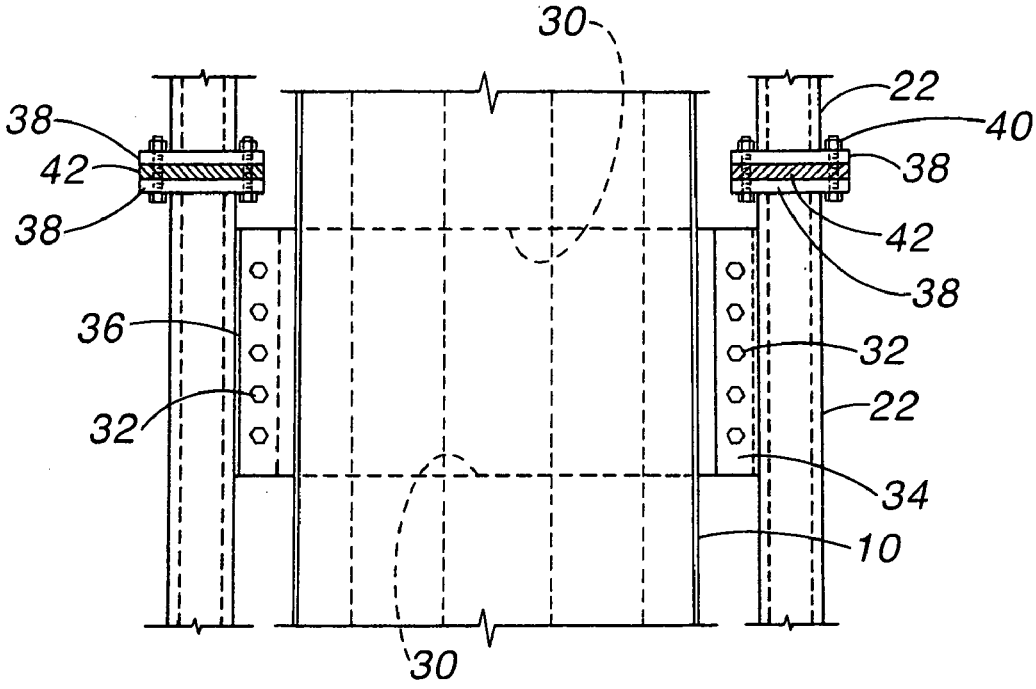
FIG. 4 is an elevational section showing a typical attachment between the reinforcement pipes and the monopole and a typical attachment between the pipes.

FIG. 2 and FIG. 3 illustrate a four-pipe column and three-pipe column reinforcement of the tower 10, respectively. The pipe columns 22 are strapped to the tower 10 by curved clamp segments 30 which bolt 32 together and to plates 34. The plates 34 are welded 36 to the pipe columns 22. This basic configuration can be adapted to permit additional pipe columns, if required. The bolted configuration spaces the pipe columns 22 from the tower 10, in effect creating a much larger diameter tower with increased resistance to bending. FIG. 4 illustrates in elevation the curved clamp segment 30 and attachment to the tower 10 and pipe columns 22.

The pipe columns 22 are formed from pipe lengths typically 20 feet long with flanges or splice plates 38 welded to the pipe ends. Bolts 40 fasten the splice plates 38 together to form the pipe columns 22. At lower elevations, the splice plates 38 are directly bolted together; however, at upper elevations, elastomeric pads 42 are bolted between the splice plates to provide compressible cushions in the pipe columns 22. The elastomeric pads 42 reduce the bending moment on the pipe columns 22 at higher elevations thereby allowing the lower cross-section higher portions of the monopole tower to continue to flex without undue compressive stress on the pipe columns. Thus, under high wind loading, the tower neutral axis shifts toward the pipes on the tension side of the tower. The thickness or compressibility of the elastomeric pads 42 may vary with the vertical elevation on the monopole tower 10. Each tower design and the proposed new antennas thereon will determine the need for elastomeric pads 42, their compressibility and thickness.

Figure 5:
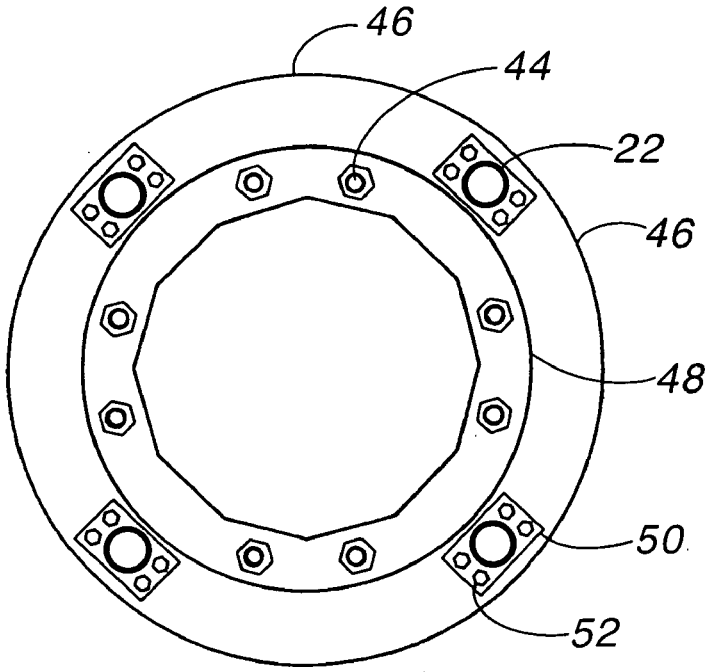
FIG. 5 is a plan view of the foundation attachment.

At the tower base 14, as shown in FIG. 5, the monopole tower 10 is bolted 44 to the concrete base 46 by a base flange 48. Outside of the base flange 48 are separate base plates 50 for each pipe column 22. The base plates 50 are directly welded to the lower most pipes of the pipe columns 22 and also bolted 52 to the concrete base 46.

Figure 6:
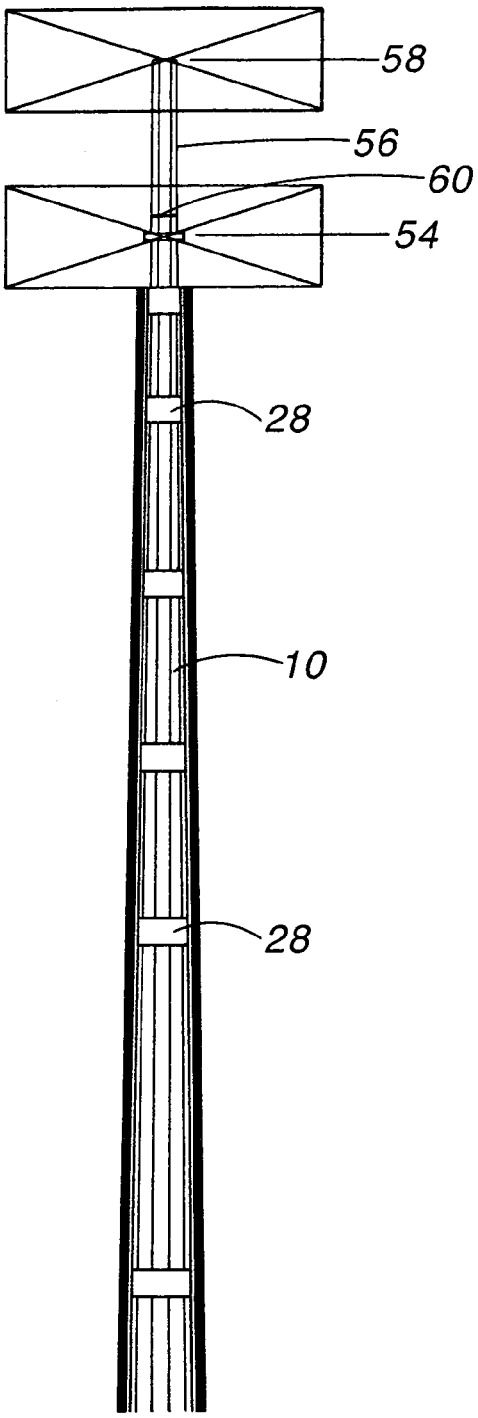
FIG. 6 illustrates a first alternative top extension of a reinforced monopole tower.

FIG. 6 illustrates a monopole tower 10 that is reinforced with pipe columns 22, as explained above. The monopole tower 10 is equipped with an existing antenna array 54; however, the pipe columns 22 add sufficient strength to the monopole tower 10 that an additional vertical extension 56 of the monopole tower can be added to support another antenna array 58. Ten to twenty feet may be added merely by welding the extension 56 to the existing tower at 60.

Figure 7:
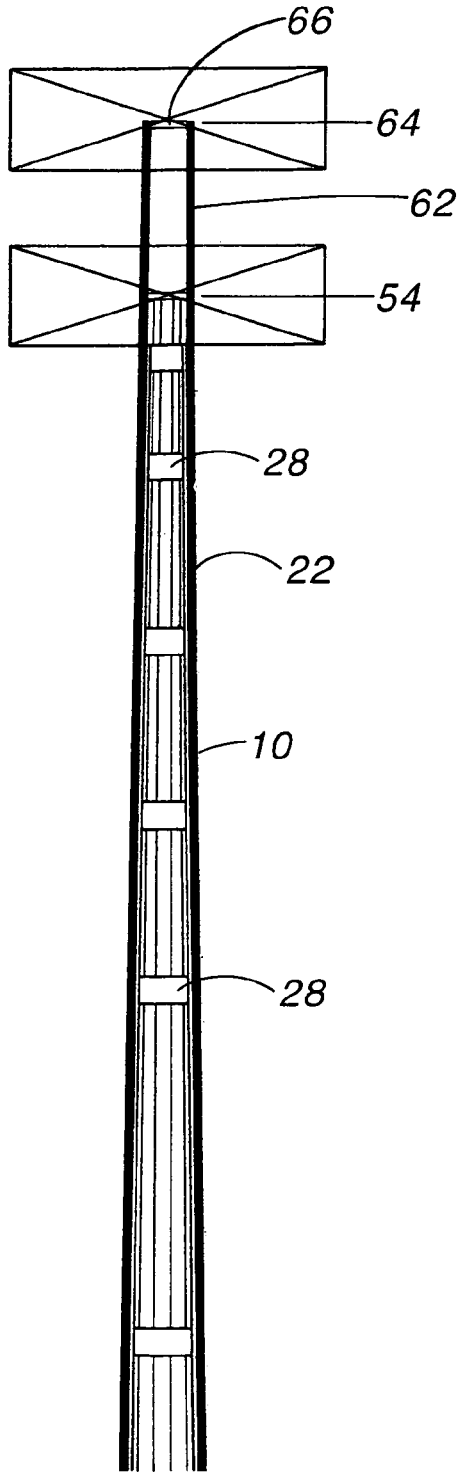
FIG. 7 illustrates a second alternative top extension of a reinforced monopole tower.

As an alternative, in FIG. 7 the pipe columns 22 are extended above the monopole tower 10. The extended pipe columns 62 support an additional antenna array 64 above the existing antenna array 54. At the very top, straps or plates 66 join the pipe columns 62 together by welding or bolting as desired.

Figure 8:
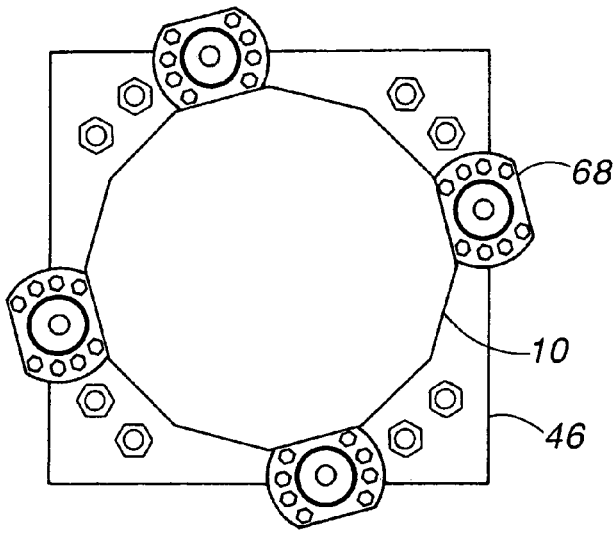
FIG. 8 is a plan view of an alternative construction that avoids field welding.

FIGS. 8 through 19 illustrate alternative constructions where certain of the polygonal panels of the monopole tower 10 must not be encumbered by straps about the tower. FIG. 8 illustrates in plan view the monopole tower 10 and a plurality of pipe columns 22 and flanges 68 at elevations above the concrete base 46.

Figure 9:
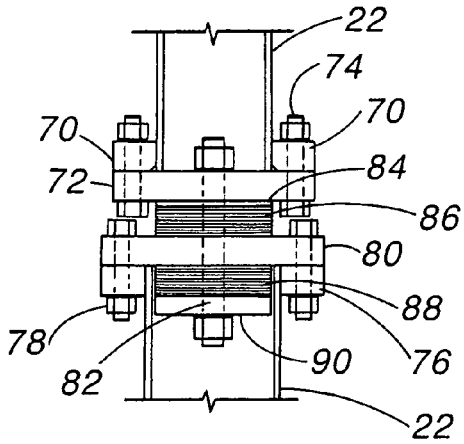
FIG. 9 is an elevational view of a pipe column reinforcement connection that avoids field welding.

In FIG. 9, an elevational view of a typical flanged pipe connection is shown. The upper flange comprises a collar plate 70 welded to the bottom of a pipe column 22 and a base plate 72 bolted 74 thereto. Similarly, a collar 76 is welded to the top of a pipe column 22 therebelow and bolted 78 to a cap plate 80. A single central threaded rod 82 passes through the base plate 72, an optional shim plate 84, a top neoprene pad 86, the cap plate 80, a bottom neoprene pad 88 and a distribution plate 90. The connection provides a flexible joint in both compression and tension, and, with pre-loading of the rod 82, no separation of the pads from the cap and base plates will occur, regardless of tension or compression forces caused by wind loading of the monopole towers. Moreover, no field welding of the connection is required.

Figure 10:
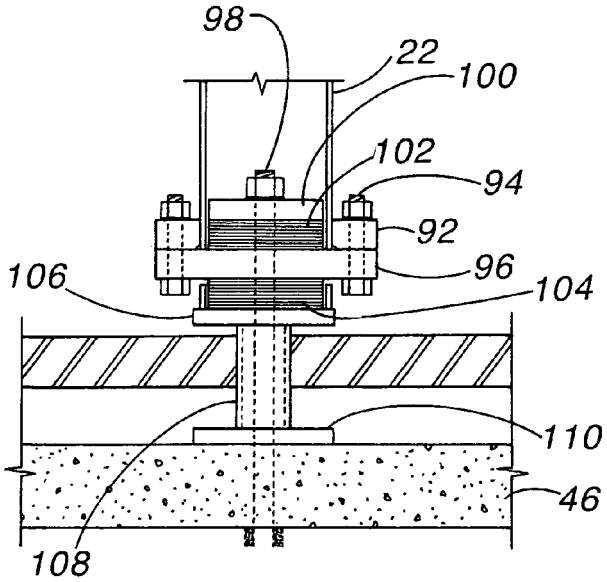
FIG. 10 is an elevational view of a pipe column reinforcement foundation connection that avoids field welding.

In a similar manner, in FIG. 10 a lowermost pipe column 22 has a collar 92 welded thereto. The collar 92 is bolted 94 to a base plate 96. A central threaded rod 98 passes through a top distribution plate 100, top neoprene pad 102, the base plate 96, a bottom neoprene pad 104 and a bottom distribution pad 106. The bottom distribution pad 106 is, in turn, supported above the concrete base 46 by a steel pipe 108 and plate 110 resting on the concrete base.

Figure 11:
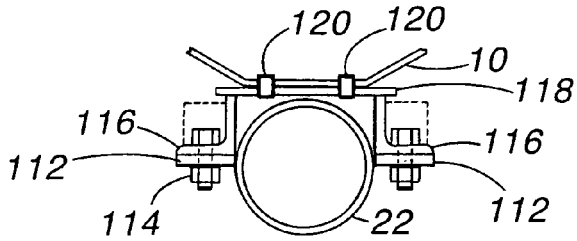
FIG. 11 is a plan view of a typical pipe column bracket that avoids field welding.
Figure 12:
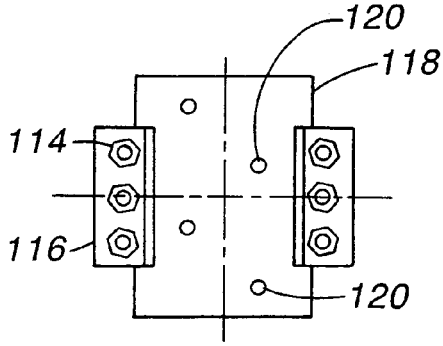
FIG. 12 is an elevational view of the bracket of FIG. 11.

In FIGS. 11 through 14, attachments of the pipe columns 22 to the monopole tower that avoid field welding are shown. In FIGS. 11 and 12, vertical plates 112 are welded to each side of the pipe column 22 and bolted 114 through vertical slots to angles 116. The angles 116, in turn, are welded to a back plate 118 which is blind bolted 120 to the tower 10.

Figure 13:
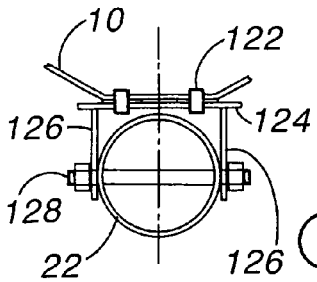
FIG. 13 is a plan view of a typical pipe column stabilizer that avoids field welding.
Figure 14:
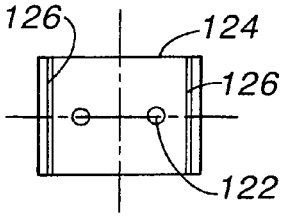
FIG. 14 is an elevational view of the stabilizer of FIG. 13.

In a similar manner, stabilizer attachments shown in FIGS. 13 and 14 are blind bolted 122 to the tower 10 and comprise a back plate 124 and a pair of side plates 126 welded thereto. The side plates 126, located to each side of a pipe column 22, are bolted thereto by a threaded rod 128 passing through the column and slotted holes in the side plates.

Figure 15:
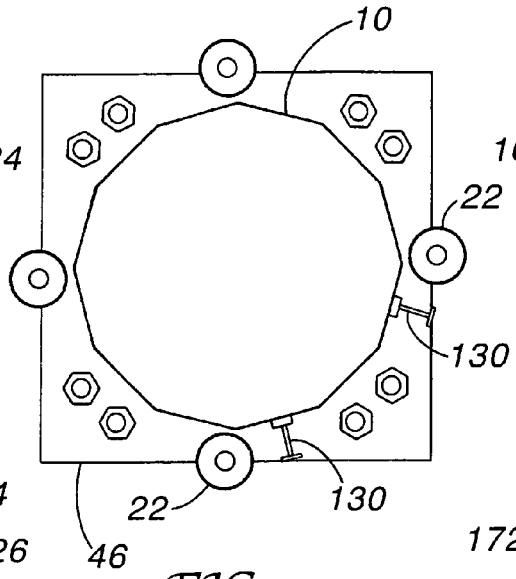
FIG. 15 is a plan view of an alternative construction that uses field welding to advantage.

FIG. 15 illustrates that, in some instances, climbing pegs 130 attached to the monopole tower 10 can interfere with the flanges, brackets, stabilizers and straps disclosed above. In such situations, the connections disclosed below are advantageous.

Figure 16:
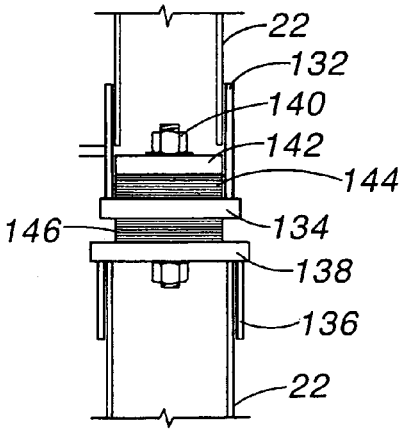
FIG. 16 is an elevational view of a pipe column connection that uses field welding to advantage.

FIG. 16 illustrates a connection wherein a pipe column 22 is welded to a top pipe sleeve 132, in turn welded to a base plate 134. In like manner, a pipe column 22 therebelow is welded to a bottom pipe sleeve 136, in turn welded to a cap plate 138. The assembly is connected together by a center threaded rod 140 passing through a distribution plate 142, a neoprene pad 144, the base plate 134, a second neoprene pad 146 and the cap plate 138. The connection provides a flexible joint in both compression and tension, and, with pre-loading of the rod 140, no separation of the pads from the cap and base plates will occur.

Figure 17:
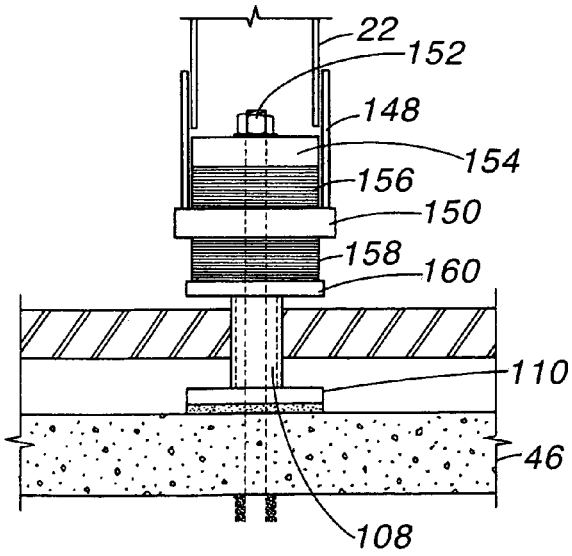
FIG. 17 is an elevational view of a pipe column foundation connection that uses field welding to advantage.

In a similar manner, in FIG. 17, a lowermost pipe column 22 is welded to a top pipe sleeve 148, in turn welded to a base plate 150. A center threaded rod 152 passes through a distribution plate 154, a neoprene pad 156, the base plate 150, a second neoprene pad 158 and a bottom distribution pad 160. The bottom distribution pad 160 is, in turn, supported above the concrete base 46 by a steel pipe 108 and plate 110 resting on the base as above.

Figure 18:
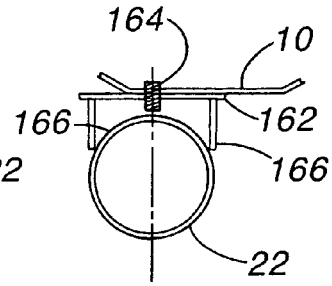
FIG. 18 is a plan view of a typical pipe column bracket that uses field welding to advantage.
Figure 19:
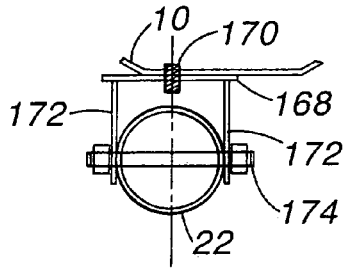
FIG. 19 is a plan view of a typical pipe column stabilizer that uses field welding to advantage.

FIG. 18 illustrates a bracket assembly comprising a back plate 162 bolted by blind bolts 164 to the tower 10. Welded to the back plate 162 are a pair of side plates 166, in turn field welded to the pipe column 22. The stabilizer assembly shown in FIG. 19 is constructed in a manner similar to the bracket of FIG. 18 comprising a back plate 168 bolted with blind bolts 170 to the tower 10. Welded to the back plate 168 are a pair of side plates 172 having vertical slotted holes through which passes a threaded rod 174 that also passes through the pipe column 22. Thus, the stabilizer differs from the bracket in providing limited vertical freedom between the tower 10 and the pipe column 22.

The invention claimed is:

1. A reinforced monopole tower comprising a tower, a plurality of pipe columns extending generally vertically about the exterior of the tower, a plurality of means attached to the pipe columns and attaching the pipe columns to the tower, said means spacing the pipe columns from the tower wherein the pipe columns comprise pipes having base plates at the bottoms thereof and cap plates at the tops thereof to connect the pipes together, and at least some of the connections between cap plates of pipe columns and base plates of pipe columns thereabove include neoprene pads therebetween.

2. The reinforced monopole tower of claim 1 wherein the cap plates and base plates are each bolted to collars, the collars being welded to the pipes.

3. The reinforced monopole tower of claim 1 wherein the cap plates and base plates are each welded to sleeves, the sleeves being welded to the pipes.

4. The reinforced monopole tower of claim 1 wherein the connections include central rods each passing through a cap plate, a neoprene pad and a base plate.

5. The reinforced monopole tower of claim 1 wherein the pipe columns extend above the monopole tower to support antennas mounted on the pipe columns.

6. A reinforced monopole tower comprising a tower, a plurality of pipe columns extending generally vertically about the exterior of the tower, a plurality of straps attached to the pipe columns and clamping the pipe columns to the tower, said pipe columns formed by pipe lengths having ends and joined together end for end, and at least one elastomeric pad located between the ends of pipe lengths joined together.

7. The reinforced monopole tower of claim 6 wherein the pipe columns extend above the monopole tower to support antennas mounted on the pipe columns.

8. The reinforced monopole tower of claim 6 wherein the pipe length ends have cap plates or base plates and a central rod passes through the at least one elastomeric pad and the adjoining cap and base plates.

* * * * *